US006624348B1

(12) United States Patent
Matsutsuka

(10) Patent No.: US 6,624,348 B1
(45) **Date of Patent: *Sep. 23, 2003**

(54) ELECTRONIC PIANO HAVING VARIABLE KEYS

(75) Inventor: Nobukado Matsutsuka, Yamaguchi (JP)

(73) Assignee: Kabushiki Kaisha Matsuya Sougou Kenkyusyo, Yamaguchi (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 1013 days.

(21) Appl. No.: 08/885,468

(22) Filed: Jun. 27, 1997

(30) Foreign Application Priority Data

Jun. 27, 1996 (JP) ..... 8/188754

(51) Int. Cl.[7] ..... G10H 1/32
(52) U.S. Cl. ..... 84/719
(58) Field of Search ..... 84/600, 615, 653, 84/719, 744

(56) References Cited

U.S. PATENT DOCUMENTS 4,711,148 A * 12/1987 Takeda et al.
4,862,784 A * 9/1989 Kimpara ..... 84/634 X
5,105,709 A * 4/1992 Suzuki ..... 84/615
5,496,963 A * 3/1996 Ito ..... 84/653
5,652,402 A * 7/1997 Kondo et al. ..... 84/653

* cited by examiner

*Primary Examiner*—Jeffrey Donels
(74) *Attorney, Agent, or Firm*—Flynn, Thiel, Boutell & Tanis, P.C.

(57) ABSTRACT

An electronic piano having a keyboard which is divided into plural zones each comprising two or more keys as one unit. with a tone being allocated to each of the zones. One can play the electronic piano in a sense of play. Besides, since each of the zones can be struck in a lump, this electronic piano is suitable for a person having large hands and fingers or a person declined in dexterity such as an old person or a physically handicapped person. This electronic piano can be utilized as a musical instrument for rehabilitation.

2 Claims, 4 Drawing Sheets

ELECTRONIC PIANO HAVING VARIABLE KEYS

TECHNICAL FIELD OF THE INVENTION

The present invention relates to an electronic piano and more particularly to an electronic piano suitable as a welfare musical instrument for physically handicapped persons and old people and capable of generating only one tone-even when adjacent keys are struck at a time.

BACKGROUND OF THE INVENTION

An electronic piano has a plurality of keys, which when struck generate tones corresponding respectively to the keys. In other words, an electronic piano is a one-key one-tone type piano. More particularly, as shown in FIG. 4. any of the tones "do", "re", "mi", "fa", "sol", "la", "si" and "do" is allocated to each key (white key).

Recently, electronic pianos have been used as welfare musical instruments for use in the rehabilitation of physically handicapped persons and old people. For striking a key of an electronic piano, a certain force is required though it is not so large as that required in the ordinary type of piano. Besides, since keys located at different positions are struck continuously, it is necessary to move the hands, fingers and arms in the right and left directions. Thus, an electronic piano is suitable as a musical instrument for rehabilitation. Particularly, not only a rehabilitation effect but also a metal effect based on playing a music piece on the piano can be expected. Further. the effect of rehabilitation becomes more and more outstanding with progress on the piano.

As mentioned above. however. since the electronic piano is a one-key one-tone type piano, the following problems are involved therein.

1. Since the keys of the electronic piano are of a uniform shape and size, a person of advanced age or a person declined in dexterity such as an old person or a physically handicapped person cannot strike a specific key and is apt to strike adjacent keys at the same time.

2. If adjacent keys are struck at a time, two different tones will be generated, so that the will to practice the piano declines. Such a piano is not suitable for the rehabilitation of physically handicapped persons.

3. A person who plays or practices the piano may have fingers which are too large to strike only a single specific key as with the case with a person of advanced age or a person declined in dexterity such as an old person or a physically handicapped person.

OBJECTS AND SUMMARY OF THE INVENTION

It is an object of the present invention to provide an electronic piano capable of generating only one tone, even when adjacent keys are struck at the same time, and thus suitable as a welfare musical instrument for physically handicapped persons and old persons. Other objects. features and advantages of the present invention will become apparent from the following description taken in connection with the accompanying drawings.

For solving the foregoing problems, according to the present invention, in the first aspect thereof, there is provided an electronic piano wherein keys are divided into plural zones, each consisting of two or more adjacent keys, and one tone is allocated to each of the zones.

In the second aspect of the present invention there is provided, in combination with the electronic piano in the first aspect, an electronic piano wherein the number of keys set for each of the zones can be changed.

In the third aspect of the present invention there is provided, in combination with the electronic piano in the first aspect, an electronic piano wherein one or both keys adjacent to the boundary between adjacent zones does not or do not generate any tone.

In the fourth aspect of the present invention there is provided, in combination with the electronic piano in the first aspect, an electronic piano wherein the arrangement of keys can be changed over to a one-key one-tone arrangement.

In the fifth aspect of the present invention there is provided, in combination with the electronic piano in the second aspect, an electronic piano wherein one or both keys adjacent to the boundary between adjacent zones does not or do not generate any tone.

In the sixth aspect of the present invention there is provided, in combination with the electronic piano in the second aspect, an electronic piano wherein the arrangement of keys can be changed over to a one-key one-tone arrangement.

In the seventh aspect of the present invention there is provided, in combination with the electronic piano in the third aspect, an electronic piano wherein the arrangement of keys can be changed over to a one-key one-tone arrangement.

In the electronic piano of the present invention, it is possible to play or practice the piano by striking keys as with the conventional one-key one-tone piano. provided in the electronic piano of the invention only one tone is generated; even when a plurality of keys present in each of preset zones are struck. Thus, the keys present in each zone can be struck in a group. In the case where this electronic piano is used as a welfare musical instrument for the rehabilitation of old persons or physically handicapped persons. it can be operated in a sense of play and hence the effect of rehabilitation is improved with progress on the piano. In setting the zones, also for the black keys, it is possible to set zones correspondingly to white keys and allocate a semi-tone to each of them. The "electronic piano" as referred to herein also covers other musical instruments having a keyboard such as electronic keyboards and electronic organs. Persons neither advanced in age nor physically handicapped can use the electronic piano in question in the same manner as the conventional electronic piano having an ordinary arrangement of keys.

According to the electronic piano of the present invention, since the keys are divided into plural zones each consisting of two or more adjacent keys and a tone is allocated to each of the zones, it is Possible to play or practice the piano in a sense of play. Besides, the keys present in each zone can be struck in a group. Thus, the electronic piano of the invention is suitable for those who play or practice the piano and whose hands and fingers are large, as well as those declined in dexterity such as old persons and physically handicapped persons. At the same time, it can be utilized as an electronic musical instrument for rehabilitation.

In the case where there is adopted the construction which permits the number of keys in each zone to be changed, the number of keys present in each zone can be changed in accordance with each stage in piano practice or the degree of rehabilitation. whereby the effect of piano practice or of rehabilitation can be further improved. In the case where there is adopted the construction wherein one or both of the keys adjacent to the boundary between adjacent zones does not or do not generate any tone, even if a person having large hands and fingers or a person declined in dexterity strikes keys of one zone and a key in another zone adjacent thereto at a time in practicing the piano, the key in another zone does not generate a tone, and thus it is possible to enhance the effect of the practice. In the case where there is adopted the construction wherein the arrangement of keys can be changed over to a one-key one-tone arrangement, the electronic piano can be used also as an ordinary type of electronic piano and thus it is possible to improve the function of the piano itself.

BEST MODE FOR CARRYING OUT THE INVENTION

A preferred embodiment of the present invention will be described below with reference to the accompanying drawings.

Figure 1:
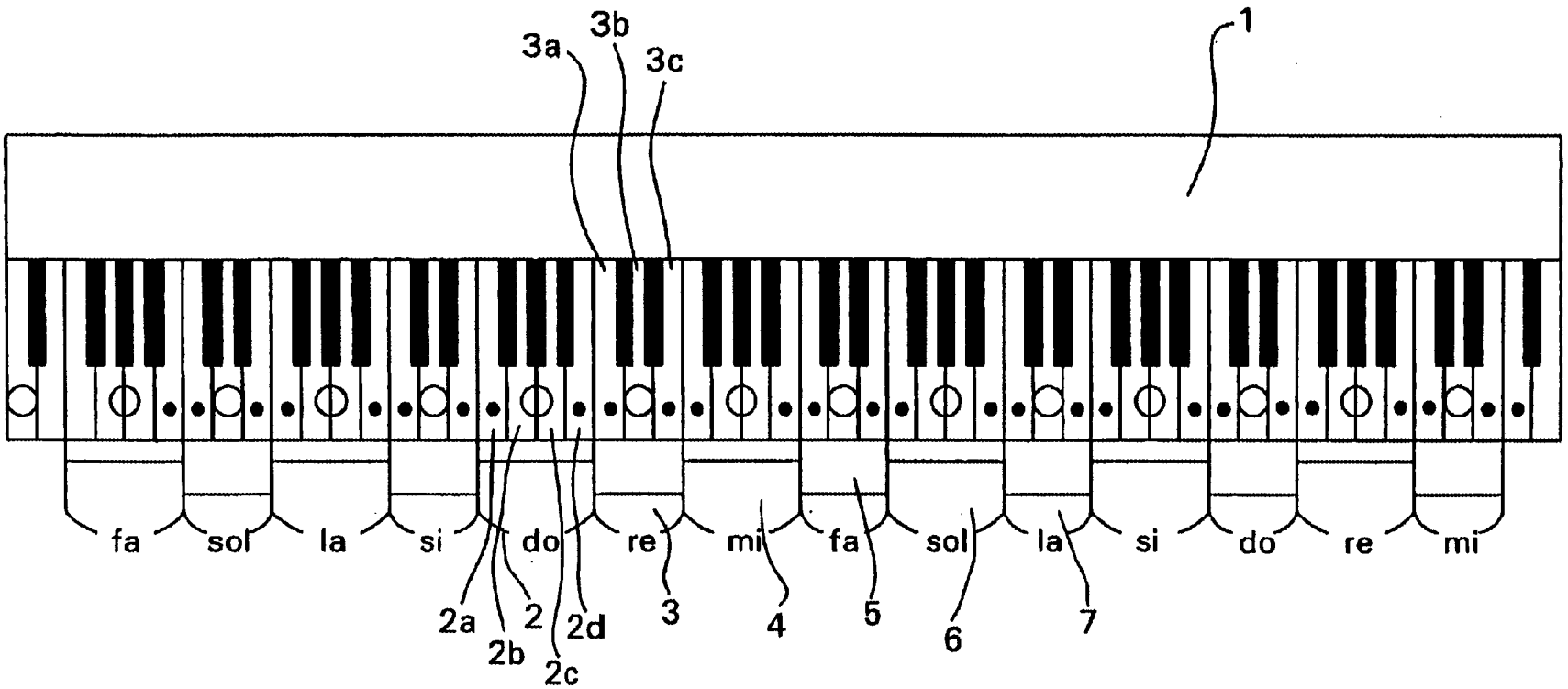
FIG. 1 is a plan view of an electronic piano according to an embodiment of the present invention. showing a keyboard and a musical scale thereof.

In an electronic piano embodying the invention, as shown in FIG. 1. a keyboard 1 is divided into plural zones 2, 3, 4, . . . , which one tone being allocated to each of the zones. For example. the keyboard 1 is set so that no matter which of keys 2*a*, 2*b*, 2*c*, . . . , in a specific zone 2 may be struck, the same tone is generated.

In FIG. 1, the zone 2 comprises four keys 2*a*, 2*b*, 2*c* and 2*d*, a zone 3 comprises three keys 3*a*, 3*b* and 3*c*, and a zone 4 comprises four keys 4*a*, 4*b*, 4*c* and 4*d*. Thus, each of the keys 2, 3, 4, . . . comprises a plurality of keys as one unit. To the zones 2, 3, and 4 are allocated "do", "re" and emit, respectively, in the musical scale. In this way, "fa", "sol", "la", "si", "do", "re", . . . are allocated successively to zones 5, 6, . . .

In each of the zones 2, 3, 4, . . . , the keys located at end portions (black dots in the figure) do not generate any tone. This is for preventing the generation of a tone of another zone adjacent to one zone simultaneous with the generation of a tone of the one zone when a key in the another zone is struck together with the keys of the one zone. In this embodiment, for example, the zone 2 comprises four keys 2*a*, 2*b*, 2*c* and 2*d*, of which the keys 2*a* and 2*d* do not generate a tone, while only the two central keys 2*b* and 2*c* generate the tone of "do." As to the zone 3, since it comprises three keys, only the central key 3*b* generates the tone of"re."

Figure 2:
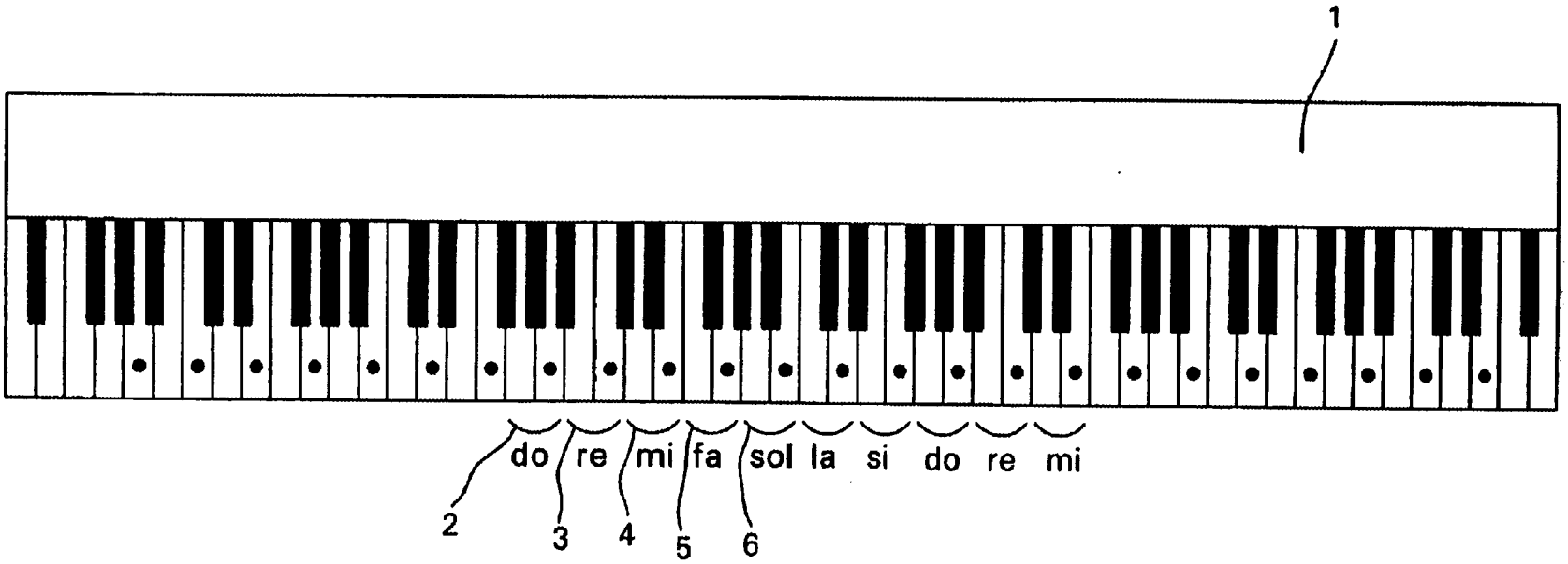
FIG. 2 is a plan view of the electronic piano, showing the keyboard with modified zones and a musical scale thereof.

The number of keys set for each of the zones 2, 3, 4, . . . can be changed as desired. For example, as shown in FIG. 2, the zones 2, 3, 4, . . . may each be composed of two keys in such a manner that only one key 2*a* (3*a*, 4*a*, . . . ) generates a tone and the other key 2*b* (3*b*, 4*b*, . . . ) does not generate any tone. Thus, the number of keys which constitute each zone can be changed in accordance with the dexterity of a person who plays or practices the piano or a person under rehabilitation.

When the electronic piano of this embodiment is to be used for rehabilitation and when, to this end, there is made change-over from the normal state, or the state which permits playing the piano on a one-key one-tone basis, to the state of this embodiment. it becomes possible to play or practice the piano by striking keys in the same manner as in the conventional piano playing. In this embodiment, for example, the tone "do" in the musical scale can be obtained by striking the keys 2*a*, 2*b*, 2*c* and 2*d* in the zone 2 in a group. However. when only the keys of a soundless portion are struck, there will be generated no tone. Thus. where this electronic piano is used as a welfare musical instrument for the rehabilitation of an old person or a physically handicapped person. it can be operated in a sense of play and the effect of rehabilitation can be improved with progress on the piano.

The present invention is not limited to the above embodiment, but modifications may be made within the scope not departing from the gist of the present invention. For example. although the above description refers to the white keys. the same construction as above is also applicable to the black keys. Although the above embodiment is constructed so as to permit playing the piano and rehabilitation in accordance with the musical scale, the invention may be constructed so as to perform practicing the piano and rehabilitation on the basis of percussion in striking keys.

Figure 3:
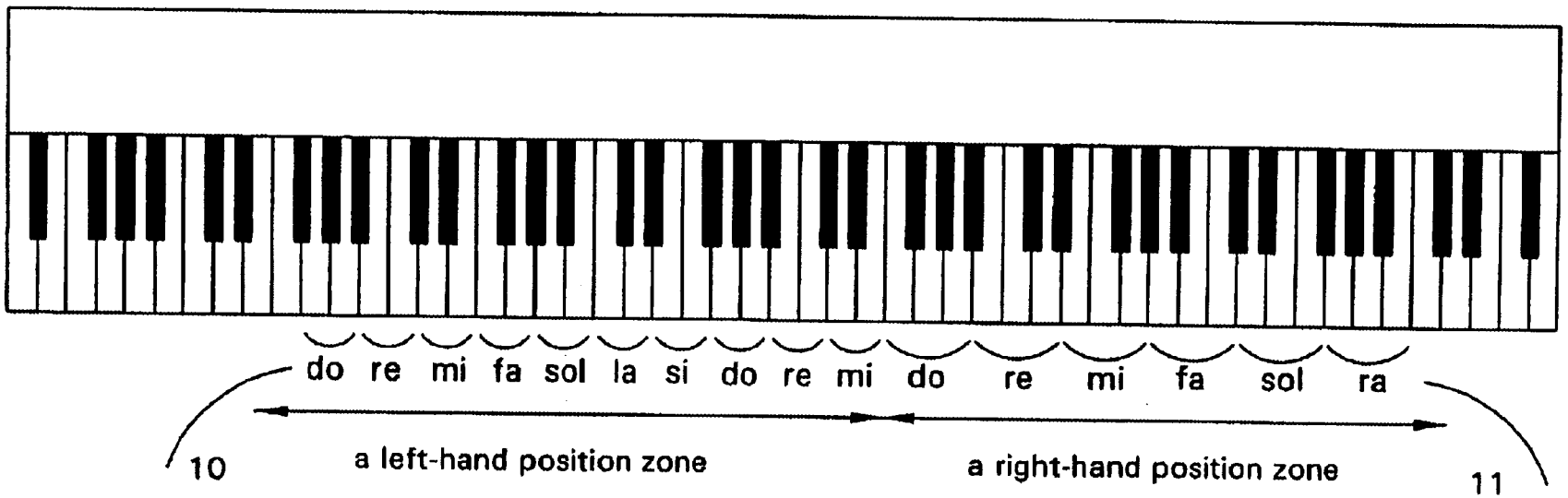
FIG. 3 is a plan view of the electronic piano, showing the keyboard with modified zones and a musical scale thereof.
Figure 4:
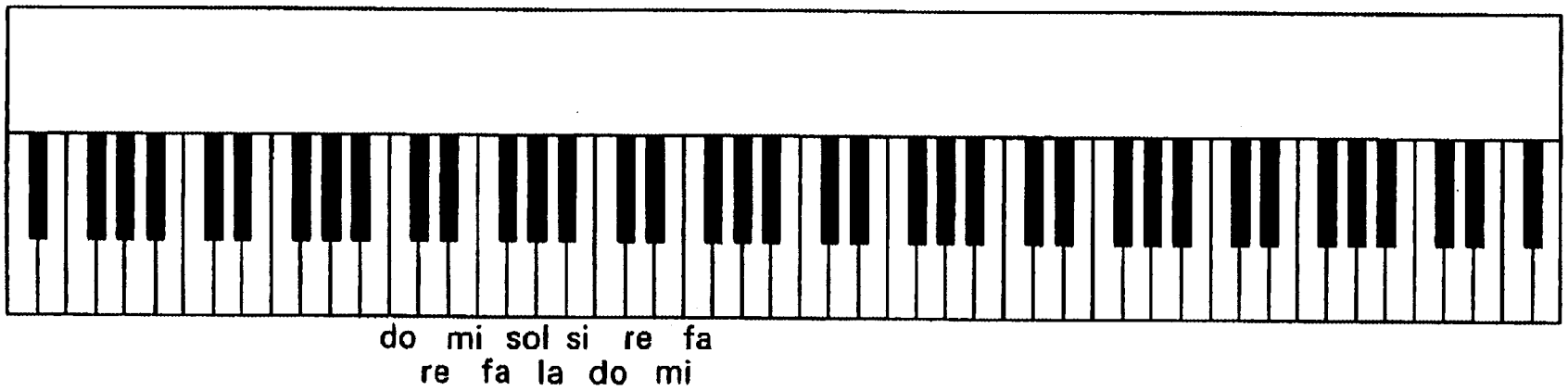
FIG. 4 is a plan view of a conventional electronic piano, showing a keyboard and a musical scale thereof.

Further, there also may be adopted such a construction as shown in FIG. 3 in which the keys are divided into a left-hand position zone 10 and a right-hand position zone 11, with the number of keys capable of being struck in a group being different between both zones 10 and 11. To be more specific, the left-hand position zone 10 comprises a plurality of zones each comprising two keys 12*a* and 12*b*, while the right-hand position zone 11 comprises a plurality of zones each comprising three keys 13*a*, 13*b* and 13*c*. Alternatively, one position zone may be made a position zone of the ordinary one-key one-tone type, while the other position zone may be made a position zone in which a plurality of adjacent keys generate one tone. Thus, by differentiating the number of keys between both position zones it becomes possible to cope with a person whose left and right hands are different in dexterity. Even a Person neither advanced in age nor physically handicapped can use the electronic Piano of the invention as an ordinary type of piano.

What is claimed is:

1. A method of varying the tonal arrangement of the keyboard of an electric piano comprising the steps of: dividing the keyboard into a plurality of divided zones containing two or more adjacent keys per zone; allocating a tone to each of the zones successively to form a music scale by the zones; and preventing one or both keys in the boundary between adjacent zones from generating a tone.

2. The method of claim 1, comprising the step of changing the number of keys contained in at least one zone.

* * * * *